US010692460B2

(12) United States Patent
Cong et al.

(10) Patent No.: US 10,692,460 B2
(45) Date of Patent: Jun. 23, 2020

(54) DISPLAY DRIVING CIRCUIT, METHOD FOR CONTROLLING THE SAME, AND DISPLAY APPARATUS

(71) Applicants: ORDOS YUANSHENG OPTOELECTRONICS CO., LTD., Ordos, Inner Mongolia (CN); BOE TECHNOLOGY GROUP CO., LTD., Beijing (CN)

(72) Inventors: Lele Cong, Beijing (CN); Jian Sun, Beijing (CN); Wenwen Qin, Beijing (CN); Han Zhang, Beijing (CN)

(73) Assignees: ORDOS YUANSHENG OPTOELECTRONICS CO., LTD., Ordos, Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/320,070

(22) PCT Filed: Mar. 8, 2018

(86) PCT No.: PCT/CN2018/078420
§ 371 (c)(1),
(2) Date: Jan. 23, 2019

(87) PCT Pub. No.: WO2018/223739
PCT Pub. Date: Dec. 13, 2018

(65) Prior Publication Data

US 2019/0228730 A1 Jul. 25, 2019

(30) Foreign Application Priority Data

Jun. 5, 2017 (CN) ..... 2017 1 0414835

(51) Int. Cl.
*G09G 3/36* (2006.01)
*G09G 3/00* (2006.01)

(52) U.S. Cl.
CPC ..... *G09G 3/3688* (2013.01); *G09G 3/006* (2013.01); *G09G 3/36* (2013.01); *G09G 2310/0297* (2013.01); *G09G 2330/04* (2013.01)

(58) Field of Classification Search
CPC ..... G09G 2310/0297; G09G 2330/04; G09G 3/006; G09G 3/3688; G09G 3/3648;
(Continued)

(56) References Cited

U.S. PATENT DOCUMENTS

2005/0285984 A1* 12/2005 Tsai ..... G02F 1/136204 349/40
2006/0279667 A1* 12/2006 Tsai ..... G02F 1/13454 349/40

(Continued)

FOREIGN PATENT DOCUMENTS

CN 105185332 A 12/2015
CN 105813365 A * 7/2016

(Continued)

OTHER PUBLICATIONS

International Search Report and English Translation of Box V of the Written Opinion dated May 30, 2018, received for corresponding Chinese Application No. PCT/CN2018/078420, 3 pages.
First Chinese Office Action dated Oct. 22, 2018, received for corresponding Chinese Application No. 201710414835.5, 10 pages.

*Primary Examiner* — Sanjiv D. Patel
(74) *Attorney, Agent, or Firm* — Kinney & Lange, P.A.

(57) ABSTRACT

Embodiments of the present application provide a display driving circuit, a method for controlling the same, and a display apparatus. The display driving circuit includes a plurality of function multiplexing circuits, and each of the (Continued)

plurality of function multiplexing circuits includes a data transmission terminal, an enabling signal terminal, a first signal terminal and a second signal terminal, and is configured to provide a test signal to the data transmission terminal and release static electricity at the data transmission terminal through the first signal terminal or the second signal terminal under control of the enabling signal terminal, the first signal terminal, and the second signal terminal, wherein the data transmission terminal is configured to be connected to at least one data line.

13 Claims, 5 Drawing Sheets

(58) Field of Classification Search
CPC ..... G09G 2330/12; G09G 3/3677; G02F 1/136204; G02F 2001/136254; H01L 27/0292
See application file for complete search history.

(56) References Cited

U.S. PATENT DOCUMENTS

2007/0268420 A1* 11/2007 Tsai ..... G02F 1/13452 349/40
2010/0156885 A1* 6/2010 Cho ..... G09G 3/006 345/214
2015/0339959 A1* 11/2015 Li ..... H02H 1/0007 324/760.01
2017/0192318 A1 7/2017 Wang et al.

FOREIGN PATENT DOCUMENTS

CN 105813365 A 7/2016
CN 106019115 A 10/2016
CN 107039015 A 8/2017

* cited by examiner

DISPLAY DRIVING CIRCUIT, METHOD FOR CONTROLLING THE SAME, AND DISPLAY APPARATUS

CROSS-REFERENCE TO RELATED APPLICATION(S)

This application is the national phase of PCT Application No. PCT/CN2018/078420 filed on Mar. 8, 2018, which in turn claims priority to the Chinese Patent Application No. 201710414835.5, filed on Jun. 5, 2017, both of which are incorporated herein by reference in their entirety.

TECHNICAL FIELD

The present disclosure relates to the field of display technologies, and more particularly, to a display driving circuit, a method for controlling the same, and a display apparatus.

BACKGROUND

In a process of manufacturing a display panel, due to the limitations of space and manufacturing process, a static electricity elimination unit cannot be provided for data lines if the display panel is a small-sized display panel, which may affect a normal operation of the display panel.

SUMMARY

According to an aspect of the embodiments of the present disclosure, there is provided a display driving circuit, comprising a plurality of function multiplexing circuits, each of the function multiplexing circuits comprises a data transmission terminal, an enabling signal terminal, a first signal terminal and a second signal terminal, and is configured to provide a test signal at the data transmission terminal and release static electricity at the data transmission terminal through the first signal terminal or the second signal terminal under control of signals at the enabling signal terminal, the first signal terminal, and the second signal terminal, wherein the a data transmission terminal is configured to be connected to at least one data line in a display panel.

In an example, the function multiplexing circuit comprises a first multiplexing sub-circuit and a second multiplexing sub-circuit, wherein the first multiplexing sub-circuit is connected to the enabling signal terminal, the first signal terminal, and the data transmission terminal, and is configured to input the signal at the first signal terminal to the data transmission terminal and release the static electricity at the data transmission terminal through the first signal terminal under control of the signals at the enabling signal terminal and the first signal terminal; and the second multiplexing sub-circuit is connected to the second signal terminal and the data transmission terminal, and is configured to stabilize a voltage at the data transmission terminal and release the static electricity at the data transmission terminal through the second signal terminal under control of the signals at the second signal terminal and the data transmission terminal.

In an example, the first multiplexing sub-circuit comprises a first transistor, wherein the first transistor has a gate connected to the enabling signal terminal, a first electrode connected to the data transmission terminal, and a second electrode connected to the first signal terminal.

In an example, the second multiplexing sub-circuit comprises a second transistor, wherein the second transistor has a gate and a first electrode connected to the data transmission terminal, and a second electrode connected to the second signal terminal.

In an example, the second multiplexing sub-circuit comprises a second transistor, wherein the second transistor has a gate and a first electrode connected to the data transmission terminal, and a second electrode connected to the second signal terminal.

In an example, the display driving circuit further comprises a multiplexer, wherein the multiplexer is connected to gating control terminals, the at least one data line, and the data transmission terminals of the plurality of function multiplexing circuits, and is configured to output a signal at each of the data transmission terminals to respective of the at least one data line under control of gating signals at the gating control terminals.

In an example, the plurality of function multiplexing circuits comprise at least one group of two function multiplexing circuits, one of which is a first function multiplexing circuit and the other of which is a second function multiplexing circuit; and the multiplexer comprises a plurality of gating sub-circuits, each connected to respective one of the at least one group and respective L data line(s) of the at least one data line, wherein each of the gating sub-circuits comprises L gating device(s), wherein odd-numbered one(s) of the L gating device(s) is(are) connected to the first function multiplexing circuit and odd-numbered one(s) of the L data line(s), and even-numbered one(s) of the L gating devices is(are) connected to the second function multiplexing circuit and even-numbered one(s) of L the data line(s), where L is a positive integer.

In an example, the display driving circuit further comprises: a source driver connected to the data transmission terminals of the plurality of function multiplexing circuits, and configured to provide a data signal to the data transmission terminals.

According to another aspect of the embodiments of the present disclosure, there is provided a display apparatus, comprising the display driving circuit described above.

In an example, the display apparatus has a plurality of layout areas, and the plurality of function multiplexing circuits are located in one of the plurality of layout areas.

According to yet another aspect of the embodiments of the present disclosure, there is provided a method for controlling the display driving circuit described above, the method comprising: for each of the plurality of function multiplexing circuits, in a test phase, controlling, by using signals at the enabling signal terminal, the first signal terminal, and the second signal terminal, the function multiplexing circuit to provide a test signal to the data transmission terminal; and in an electrostatic protection phase, controlling, by using signals at the enabling signal terminal, the first signal terminal, and the second signal terminal, the function multiplexing circuit to release static electricity at the data transmission terminal through the first signal terminal or the second signal terminal.

In an example, in a case that the function multiplexing circuit comprises a first multiplexing sub-circuit and a second multiplexing sub-circuit, controlling the function multiplexing circuit to provide a test signal to the data transmission terminal comprises: controlling, by using the signals at the enabling signal terminal and the first signal terminal, the first multiplexing sub-circuit to input a signal at the first signal terminal to the data transmission terminal as a test signal, and controlling, by using the signals at the second signal terminal and the data transmission terminal, the second multiplexing sub-circuit to stabilize a voltage at the data transmission terminal; and controlling the function multiplexing circuit to release static electricity at the data transmission terminal through the first signal terminal or the second signal terminal comprises: controlling, by using the signals at the enabling signal terminal and the first signal terminal, the first multiplexing sub-circuit to release static electricity at the data transmission terminal through the first signal terminal, and controlling, by using the signals at the second signal terminal and the data transmission terminal, the second multiplexing sub-circuit to release the static electricity at the data transmission terminal through the second signal terminal.

In an example, the first multiplexing sub-circuit comprises a first transistor, and controlling the first multiplexing sub-circuit to release static electricity at the data transmission terminal through the first signal terminal comprises: applying the same level to the enabling signal terminal and the first signal terminal. In an example, the plurality of function multiplexing circuits comprise at least one group of two function multiplexing circuits, one of which is a first function multiplexing circuit and the other of which is a second function multiplexing circuit, and wherein controlling the function multiplexing circuit to provide a test signal to the data transmission terminal comprises: for a first image frame, applying a first level to the first signal terminal of the first function multiplexing circuit, and applying a second level to the first signal terminal of the second function multiplexing circuit; and for a second image frame, applying a second level to the first signal terminal of the first function multiplexing circuit, and applying a first level to the first signal terminal of the second function multiplexing circuit.

BRIEF DESCRIPTION OF THE DRAWINGS

In order to more clearly illustrate the embodiments of the present disclosure or the conventional technical solutions, the accompanying drawings to be used in the description of the embodiments or the conventional technology will be briefly described below. It is apparent that the accompanying drawings in the following description are only some of the embodiments of the present disclosure, and other accompanying drawings may be obtained by those of ordinary skill in the art according to these accompanying drawings without contributing any creative work.

DETAILED DESCRIPTION

The technical solutions in the embodiments of the present disclosure will be clearly and completely described below in conjunction with the accompanying drawings in the embodiments of the present disclosure. It is apparent that the embodiments described are only a part of the embodiments of the present disclosure, instead of all the embodiments. All other embodiments obtained by those of ordinary skill in the art based on the embodiments of the present disclosure without contributing any creative work shall fall within the protection scope of the present disclosure.

Furthermore, in the description of the embodiments of the present disclosure, the term "connected with" or "connected to" may mean that two components are directly connected, or that two components are connected via one or more other components.

Further, in the description of the embodiments of the present disclosure, the terms "first level" and "second level" are only used to distinguish magnitudes of the two levels from each other. For example, the following description will be made by taking the "first level" being a high level and the "second level" being a low level as an example. It can be understood by those skilled in the art that the present disclosure is not limited thereto.

Transistors used in the embodiments of the present disclosure may all be thin film transistors or field effect transistors or other devices having the same characteristics. Preferably, the thin film transistors used in the embodiments of the present disclosure may be oxide semiconductor transistors. As a source and a drain of a thin film transistor used here are symmetrical, the source and the drain thereof are interchangeable. In the embodiments of the present disclosure, one of the source and the drain is referred to as a first electrode, and the other of the source and the drain is referred to as a second electrode. In the following examples, N-type thin film transistors are taken as an example for description. It will be appreciated to those skilled in the art that the embodiments of the present disclosure are obviously applicable to a case of P-type type thin film transistors.

Figure 1:
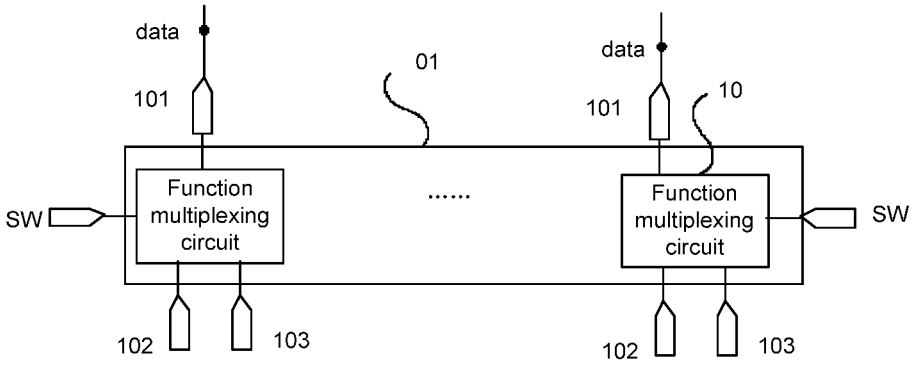
FIG. 1 is a structural diagram of a display driving circuit according to an embodiment of the present disclosure.

The embodiments of the present disclosure provide a display driving circuit. As shown in FIG. 1, the display driving circuit 01 comprises a plurality of function multiplexing circuits 10. Each of the function multiplexing circuits 10 is connected to at least one data line DL in the display panel through a data transmission terminal 101 to input a test signal to the data line DL. The function multiplexing circuit 10 further has an enabling signal terminal SW, a first signal terminal 102 and a second signal terminal 103. Only a connection between two of the function multiplexing circuits 10 is shown in FIG. 1, and connection between other function multiplexing circuits 10 may be known with reference to this connection line.

A Cell Test (CT) function and an Electro-Static Discharge (ESD) function for the display panel may be multiplexed in the display driving circuit 01. Here, in a test phase, a test signal input to the display panel may be transmitted to the data line DL of the display panel through the function multiplexing circuit 10. For example, the function multiplexing circuit 10 provides the test signal to the data line DL under control of signals at the enabling signal terminal SW, the first signal terminal 102, and the second signal terminal 103. In addition, in a display phase (which may also be referred to as an electrostatic protection phase because of the need for electrostatic protection in this phase), the function multiplexing circuit 10 releases static electricity at the data transmission terminal 101 through the first signal terminal 102 or the second signal terminal 103. The data transmission terminal 101 may be a signal terminal for transmitting a data signal to the data line. Generally, a source driver may be connected to the data transmission terminal 101 to input the data signal to the data line DL; while static electricity in the data signal may be released through the function multiplexing circuit 10.

It should be illustrated that the test signal is used to drive pixels in the display panel for display in the test phase, for example, before a driving circuit (source driver, or referred to as source driving Integrated Circuit (IC)) for transmitting a signal to the data line is formed in the display panel, thereby achieving test of the display performance of the pixels. Here, the test signal may be provided by an external controller.

Further, the display driving circuit 01 further comprises a source driver connected to the data transmission terminals 101. The source driver is used to provide data signals to the data transmission terminals 101 in the display phase. Since the data transmission terminals 101 are connected to the data lines DLs in the display panel, the source driver may transmit the data signals to the data lines DLs. When there is high static electricity (for example, a positive voltage or a negative voltage exceeding a threshold) at the data transmission terminal 101 due to the data signals provided by the source driver, the static electricity may be released through the first signal terminal 102 or the second signal terminal 103. An exemplary releasing process will be described during subsequent operation processes of the function multiplexing circuit 10.

Based thereon, the display driving circuit 01 is driven in a time-division manner, so that in the test phase, a signal at the first signal terminal 102 is input to the data transmission terminal 101 under control of the enabling signal terminal SW, the first signal terminal 102 and the second signal terminal 103, to provide a test signal to the data line connected to the data transmission terminal 101, thereby achieving test of the display performance of the pixels in the display panel; and in the electrostatic protection phase, static electricity at the data transmission terminal 101 is released through the first signal terminal 102 or the second signal terminal 103 under control of the enabling signal terminal SW, the first signal terminal 102 or the second signal terminal 103. Thereby, after the design of the display driving circuit 01 is completed, wirings and a layout related to the electrostatic protection and the display performance test may be completed at the same time, thereby effectively solving the problem that an electrostatic protection circuit cannot be designed because of the difficulty in the layout and the wirings caused by a limited space in a layout design of a display apparatus.

In addition, a conventional panel has a problem that a test circuit is idle after the test of display performance, which causes a large waste of wiring space for a small-sized display panel, especially a small-sized shaped display panel having a frame in a circular shape, a polygonal shape, or other curved shapes. In the present disclosure, the display driving circuit 01 having the function multiplexing circuits 10 is designed in a limited space, to test the display performance of the display panel in the display performance test phase, and release the static electricity at the data transmission terminals 101 in the electrostatic protection phase, thereby avoiding the idleness of the display driving circuit 01.

Figure 2:
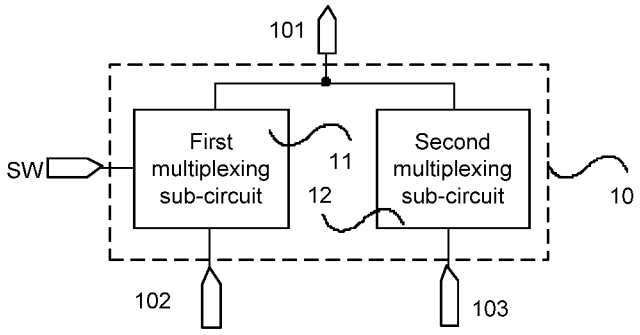
FIG. 2 is a structural diagram of a function multiplexing circuit in the display driving circuit shown in FIG. 1.

As shown in FIG. 2, the function multiplexing circuit 10 may comprise a first multiplexing sub-circuit 11 and a second multiplexing sub-circuit 12.

The first multiplexing sub-circuit 11 is connected to the enabling signal terminal SW, the first signal terminal 102, and the data transmission terminal 101. The first multiplexing sub-circuit 11 is configured to input the signal at the first signal terminal 102 to the data transmission terminal 101 and release the static electricity at the data transmission terminal 101 through the first signal terminal 101 under control of the signals at the enabling signal terminal SW and the first signal terminal 102.

The second multiplexing sub-circuit 12 is connected to the second signal terminal 103 and the data transmission terminal 101. The second multiplexing sub-circuit 12 is configured to stabilize a voltage at the data transmission terminal 101 and release the static electricity at the data transmission terminal 101 through the second signal terminal 103 under control of the signals at the second signal terminal 103 and the data transmission terminal 101.

Figure 3:
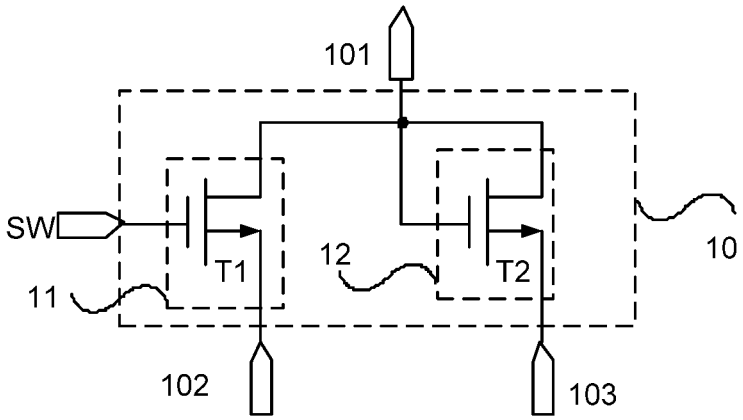
FIG. 3 is a circuit diagram of the function multiplexing circuit shown in FIG. 2.

An exemplary structure of the first multiplexing sub-circuit 11 and the second multiplexing sub-circuit 12 will be described below. As shown in FIG. 3, the first multiplexing sub-circuit 11 may comprise a first transistor T1 having a gate connected to the enabling signal terminal SW, a first electrode connected to the data transmission terminal 101, and a second electrode connected to the first signal terminal 102. The second multiplexing sub-circuit 12 may comprise a second transistor T2 having a gate and a first electrode connected to the data transmission terminal 101 and a second electrode connected to the second signal terminal 103.

It should be illustrated that when each of the transistors described above is an N-type transistor, a first electrode thereof is a source and a second electrode thereof is a drain, and a constant high level is applied to the second signal terminal 103; and when each of the transistors described above is a P-type transistor, a first electrode thereof is a drain and a second electrode thereof is a source, and a constant low level is applied to the second signal terminal 103.

Each of the data transmission terminals 101 may be connected to the data line through a data lead. If each of the data transmission terminals 101 is connected to only one data line, since data leads in the display panel have dense wirings for a small-sized display panel with a high Pixel Per Inch (PPI), a short-circuit phenomenon is prone to occur. To this end, the display driving circuit may further comprise a multiplexer, which will be described below with reference to FIGS. 5 and 6.

Figure 5:
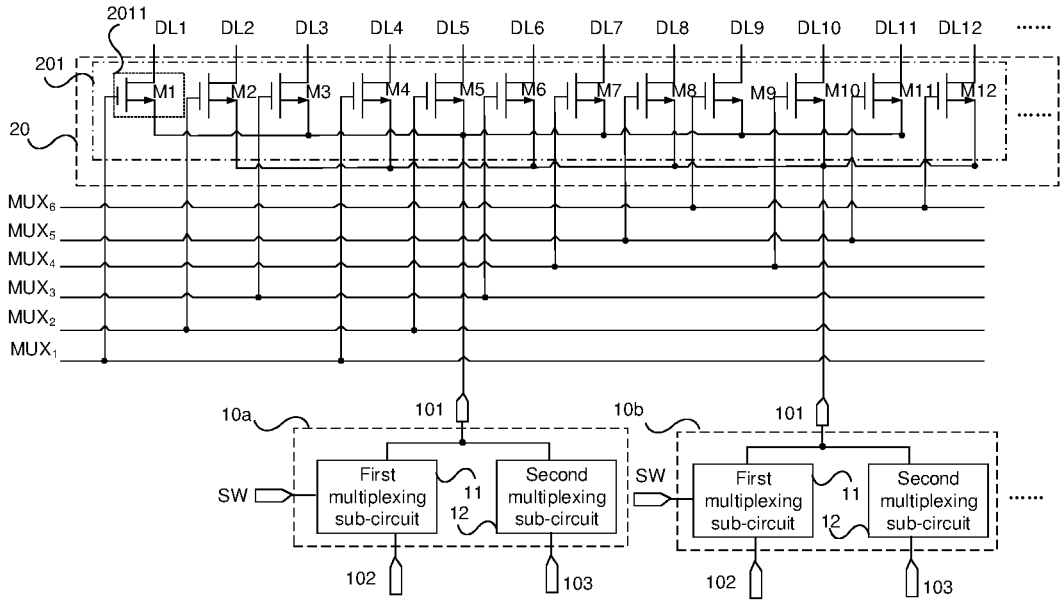
FIG. 5 is a structural diagram of another display driving circuit according to an embodiment of the present disclosure.
Figure 6:
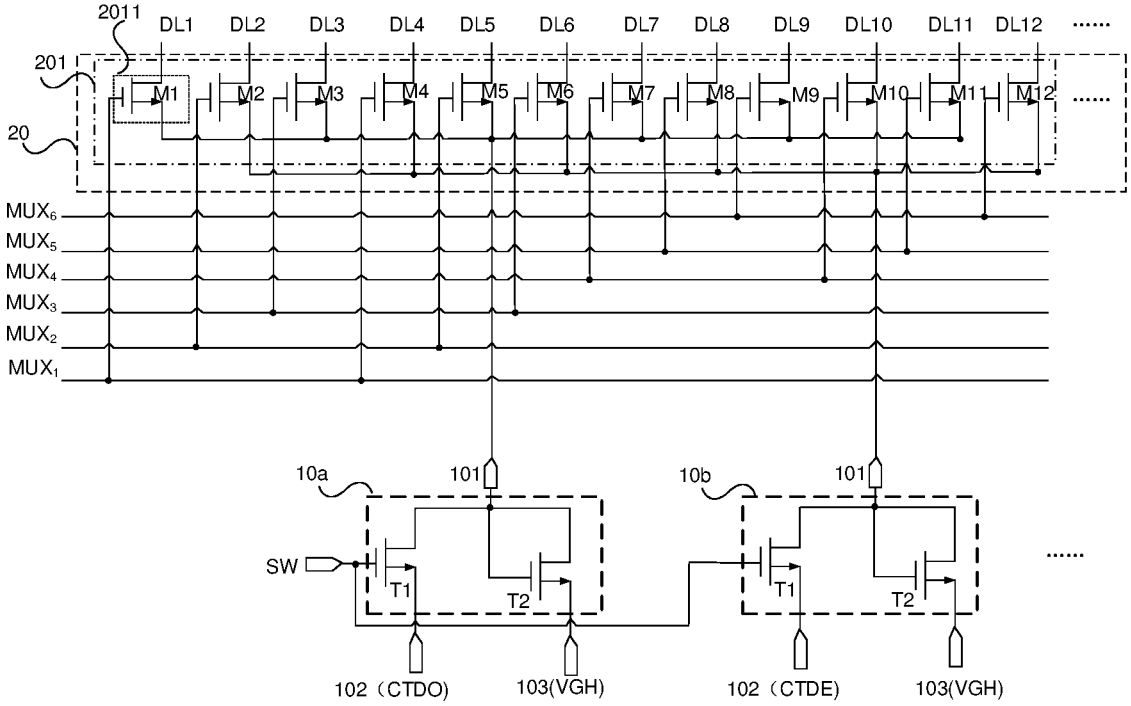
FIG. 6 is a circuit diagram of the display driving circuit shown in FIG. 5.

As shown in FIG. 5, the display driving circuit comprises a plurality of function multiplexing circuits 10*a* and 10*b* (which are collectively referred to as function multiplexing circuits 10) and a multiplexer 20. The multiplexer 20 is connected to gating control terminals $MUX_1$, $MUX_2$, . . . , $MUX_N$, data lines DL1 to DL12, and the data transmission terminals 101 of the function multiplexing circuits 10, wherein N is a positive integer. Here, the multiplexer 20 is configured to output signals of the function multiplexing circuits 10 to respective of the data lines DL1 to DL12, thereby reducing a number of data leads to be provided and thus decreasing the probability of the short-circuit phenomenon due to dense wirings. As shown in FIG. 6, the function multiplexing circuit 10 may have the circuit structure described above with reference to FIGS. 1 to 3.

As shown in FIG. 5, the plurality of function multiplexing circuits 10 may be divided into at least one group, for example, including a group of the function multiplexing circuits 10*a* and 10*b*. The multiplexer 20 may comprise a plurality of gating sub-circuits 201 (as shown by the dotted block in the figure), and each of the gating sub-circuits 201 is connected to the group of function multiplexing circuits 10*a* and 10*b*. For example, each of the gating sub-circuits 201 may comprise L gating devices 2011, wherein odd-numbered ones of the gating devices 2011 are connected to the function multiplexing circuit 10*a* and odd-numbered ones of the data lines, and even-numbered ones of the gating devices 2011 are connected to the function multiplexing circuit 10*b* and even-numbered ones of the data lines, where L is a positive integer.

FIG. 5 is illustrated by taking L=12 and N=6 as an example, that is, by taking each of the gating sub-circuits 201 comprising twelve gating devices 2011 and the multiplexer 20 comprising six gating control terminals $MUX_1$, $MUX_2$, . . . , $MUX_6$ as an example. In this case, each of the data transmission terminals 101 may provide a data signal to six data lines, and therefore the two function multiplexing circuits 10*a* and 10*b* provide a data signal to twelve gating devices 2011 of one gating sub-circuit 201. As shown in FIG. 5, each gating device 2011 may comprise one transistor, and therefore each of the gating sub-circuits 201 comprises twelve transistors M1 to M12, wherein each of the transistors M1 to M12 has a gate connected to a respective one of the gating control terminals $MUX_1$-$MUX_6$, and a first electrode connected to a respective one of the data lines DL1 to DL12, a second electrode of each of the transistors M1, M3, M5, M7, M9 and M11 is connected to the data transmission terminal 101 of the function multiplexing circuit 10*a*; and a second electrode of each of the transistors M2, M4, M6, M8, M10 and M12 is connected to the data transmission terminal 101 of the function multiplexing circuit 10*b*.

Of course, each of the gating sub-circuits 201 may further comprise other numbers of gating devices 2011, for example, six gating devices 2011, that is, L=6. In this case, each of the data transmission terminals 101 may provide a data signal to three data lines. In addition, although FIG. 5 illustrates only two function multiplexing circuits 10*a* and 10*b* and one gating sub-circuit 201, the embodiments of the present disclosure are not limited thereto, and a number of function multiplexing circuits and a number of gating sub-circuits may be selected as needed. A number of the gating control terminals MUX and a connection manner between the gating control terminals MUX and the gating devices 2011 are not limited to the example shown in FIG. 5, and may be selected as needed.

Figure 7:
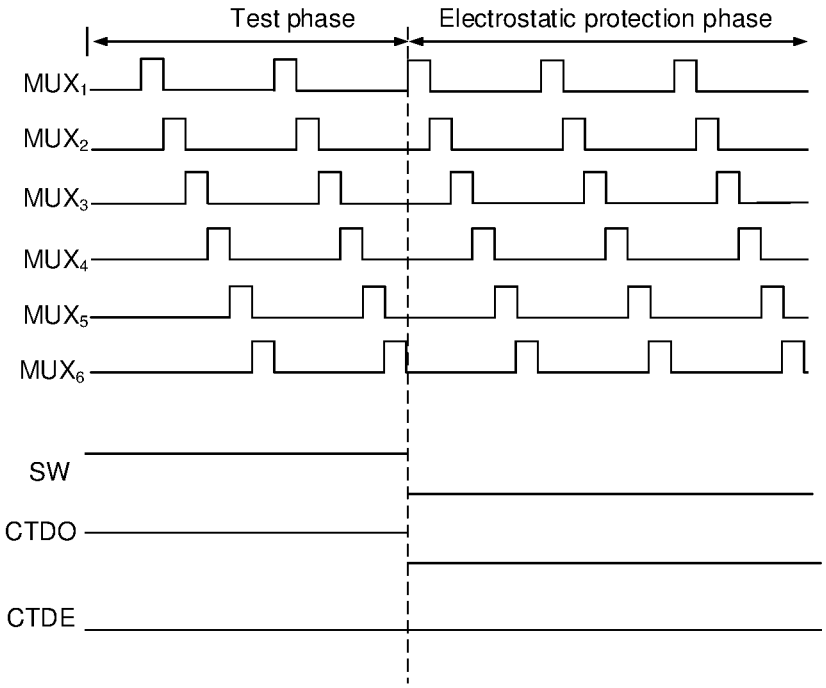
FIG. 7 is a control timing diagram of the display driving circuit shown in FIG. 6.

An operation process of the display driving circuit shown in FIG. 6 will be exemplified below in conjunction with a timing control diagram shown in FIG. 7.

As shown in FIG. 6, an enabling signal terminal SW of the function multiplexing circuit 10*a* receives an enabling signal, a first signal terminal 102 of the function multiplexing circuit 10*a* receives a test signal CTDO, and a second signal terminal 103 of the function multiplexing circuit 10*a* receives a power supply signal VGH; and an enabling signal terminal SW of the function multiplexing circuit 10*b* receives an enabling signal, a first signal terminal 102 of the function multiplexing circuit 10*b* receives a test signal CTDE, and a second signal terminal 103 of the function multiplexing circuit 10*b* receives a power supply signal VGH.

In a test phase, the enabling signal at the enabling signal terminal SW is at a high level, and the power supply signal VGH is at a high level. At this time, the first transistors T1 of the function multiplexing circuits 10*a* and 10*b* are turned on, and test signals CTDO and CTDE input at the first signal terminals 102 are input to the multiplexer 20 through the data transmission terminals 101.

For the function multiplexing circuit 10*a*, when the test signal CTDO is at a high level, since the first transistor T1 is turned on, the test signal CTDO is transmitted to the data transmission terminal 101 through the first transistor T1, so that the data transmission terminal 101 is at a high level. At this time, since the power supply signal VHG and the test signal CTDO are at the same high level, if the level at the data transmission terminal 101 is the same as the level of the power supply signal VHG and the test signal CTDO, a gate-source voltage Vgs of the second transistor T2 is equal to 0, and the second transistor T2 is turned off; and if there is static electricity in the test signal CTDO such that the levels at the data transmission terminal 101 and the second signal terminal 103 cause the gate-source voltage Vgs of the second transistor T2 to be greater than a threshold voltage Vth of the second transistor T2, then the second transistor T2 is turned on, and the static electricity at the data transmission terminal 101 is transmitted from the second transistor T2 to the second signal terminal 103, thereby maintaining the level at the data transmission terminal 101 to be stable. When the test signal CTDO is at a low level, since the first transistor T1 is turned on, the test signal CTDO is transmitted to the data transmission terminal 101 through the first transistor T1, so that the data transmission terminal 101 is at a low level, and the second transistor T2 is turned off at this time. An operation manner of the function multiplexing circuit 10*b* is the same as that of the function multiplexing circuit 10*a*, and will not be described herein.

When a gating control terminal $MUX_1$ is at a high level, transistors M1 and M4 in the multiplexer 20 are turned on. Since the transistor M1 is connected to the data transmission terminal 101 of the function multiplexing circuit 10*a* and the transistor M4 is connected to the data transmission terminal 101 of the function multiplexing circuit 10*b*, the function multiplexing circuit 10*a* transmits a test signal CTDO to the data line DL1 connected to the first transistor M1, and the function multiplexing circuit 10*b* transmits a test signal CTDE to a data line DL4 connected to the fourth transistor M4. When the gating control terminal $MUX_1$ is at a low level, the transistors M1 and M4 are both turned off, and at this time, writing of signals to the data lines DL1 and DL4 is stopped.

A principle of writing signals to other data lines DLs is the same as that of writing signals to the data lines DL1 and DL4 described above, and will not be described again here. In addition, column inversion driving may be realized by controlling the test signals CTDO and CTDE to be transitioned between a high level and a low level, thereby reducing the probability that liquid crystal in the display panel ages due to an unchanged rotation angle of the liquid crystal for a long time or a small rotation angle of the liquid crystal. For example, for a first image frame, the test signal CTDO is at a high level, and the test signal CTDE is at a low level; and for a second image frame, the test signal CTDO is at a low level, and the test signal CTDE is at a high level. In some embodiments, the first image frame and the second image frame may be two adjacent image frames.

Thus, test signals written to two adjacent data lines are at opposite levels. When a screen is displayed, a test signal is continuously inverted between a high level and a low level.

Even if the screen has a small change in grayscale, a rotation angle of the liquid crystal may continuously change, so that the phenomenon that the liquid crystal ages due to an unchanged rotation angle of the liquid crystal for a long time is alleviated.

Figure 4A:
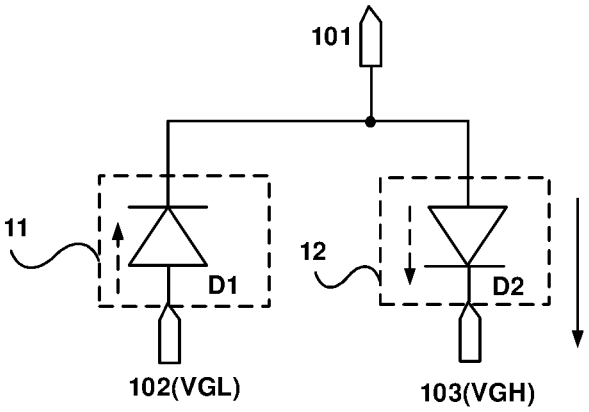
FIGS. 4*a*-4*b* are equivalent circuit diagrams of the function multiplexing circuit shown in FIG. 3.
Figure 4B:
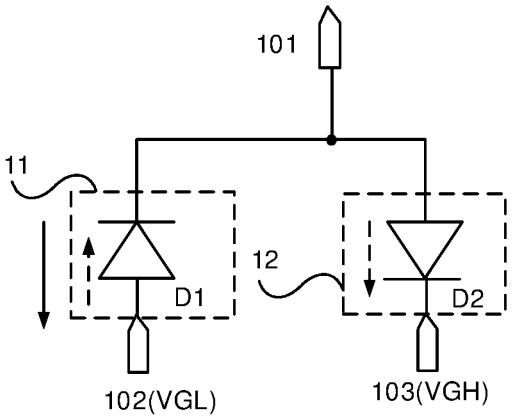

In an electrostatic protection phase, for example, a data signal is provided and input to each of the data transmission terminals 101 of the function multiplexing circuits 10*a* and 10*b* by the source driver in the display panel. The enabling signals at the enabling control terminals SW of the function multiplexing circuits 10*a* and 10*b* become a low level, the test signals CTDO and CTDE at the first signal terminals 102 of the function multiplexing circuits 10*a* and 10*b* are at a low level, and the power supply signals VGH at the second signal terminals 103 of the function multiplexing circuits 10*a* and 10*b* are at a high level. At this time, an equivalent circuit diagram of the function multiplexing circuit 10 in FIG. 3 is as shown in FIGS. 4*a* and 4*b*, in which the first transistor T1 and the second transistor T2 operate as a diode D1 and a diode D2, respectively. A positive electrode of the diode D1 is at a low level (for example, a reference level VGL of +5V), and a negative electrode of the diode D1 receives a data signal, and a positive electrode of the diode D2 receives a data signal, and a negative electrode of the diode D2 is at a high level (for example, a power supply level VGH of +5V).

When there is positive static electricity (at for example, +30V) exceeding a threshold in the data signal at the data transmission terminal 101, the positive electrode of the diode D2 is connected to +30V, and the negative electrode of the diode D2 is connected to +5V. Therefore, the diode D2 is turned on, and the positive static electricity is transmitted from the positive electrode of the diode D2 to the negative electrode of the diode D2 (as shown by solid arrows in FIG. 4*a*), that is, the positive static electricity at the data transmission terminal 101 is released through the second signal terminal 103.

When there is negative static electricity (at for example, −30V) exceeding a threshold in the data signal at the data transmission terminal 101, the positive electrode of the diode D1 is connected to −5V, and the negative electrode of the diode D1 is connected to −30V. Therefore, the diode D1 is in a reverse breakdown state, and the negative static electricity is transmitted from the negative electrode of the diode D1 to the positive electrode of the diode D1 (as shown by solid arrows in FIG. 4*b*), that is, the negative static electricity at the data transmission terminal 101 is released through the second signal terminal 102.

Figure 8:
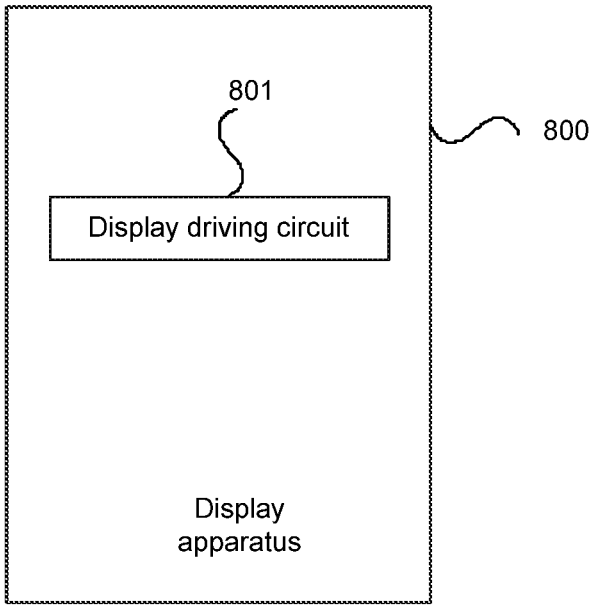
FIG. 8 illustrates a schematic diagram of a display apparatus according to an embodiment of the present disclosure.

As shown in FIG. 8, the embodiments of the present disclosure provide a display apparatus 800 comprising the display driving circuit 801 according to the embodiments of the present disclosure. The display driving circuit 801 may be implemented by the display driving circuit described above.

In addition, the display apparatus according to the embodiment of the present disclosure may further comprise a gate driving circuit, an Electrics Test (ET) terminal, a rapid discharging circuit, a ground terminal (GND), etc. The test signals CTDO and CTDE and the enabling signals may be input to the display driving circuit 01 through the ET terminal.

Figure 9:
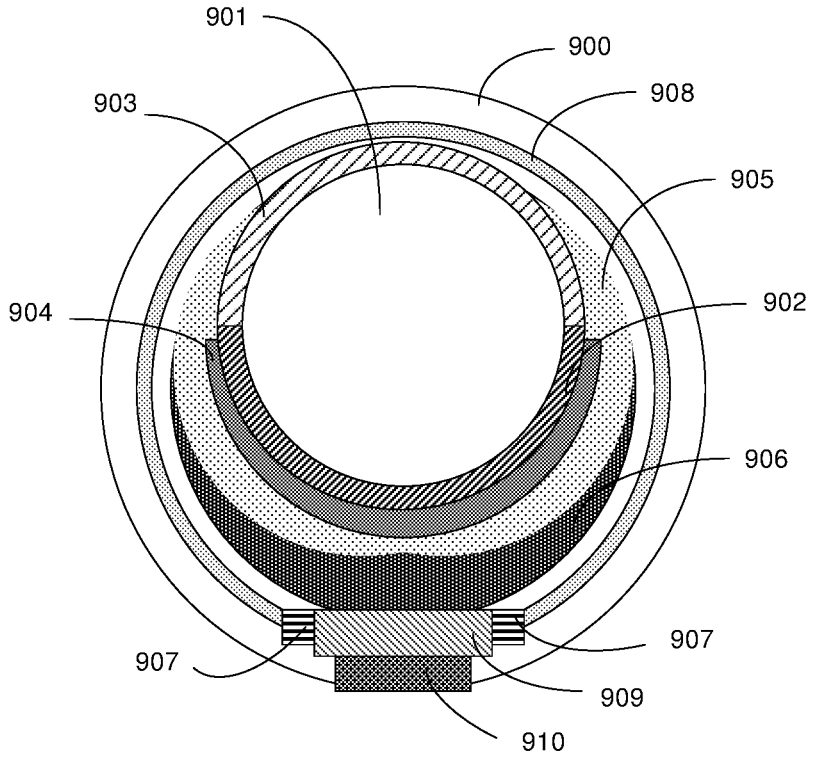
FIG. 9 illustrates a schematic diagram of a layout of a display apparatus according to an embodiment of the present disclosure.

As shown in FIG. 9, the display apparatus 900 has a plurality of wiring areas, such as areas 901 to 910. For example, the area 901 is an Active Area (AA). A Multiplexer (MUX), for example, the multiplexer 20 described above, may be provided in the area 902. A rapid discharge circuit may be disposed in the area 903. The area 904 is a function multiplexing area, and the function multiplexing circuits 01 described above may be disposed in the area 904. For example, both the first multiplexing sub-circuit 11 and the second multiplexing sub-circuit 12 of the function multiplexing circuit 01 are disposed in the area 904. A gate driving circuit, for example, a Gate Driver on Array (GOA), is disposed in the area 905. The area 906 is a fan-out area. An electrics test terminal may be disposed in the area 907. A ground terminal may be disposed in the area 908. An integrated circuit (IC), for example, a display driving IC, may be disposed in the area 909. The source driving circuit described above may be disposed in the display driving IC. A Flexible Printed Circuit board (FPC) may be disposed in the area 910. In FIG. 9, the display apparatus 900 is designed to be circular, and the circular area 901 is substantially at a center of the display apparatus 800; the strip-shaped areas 902 and 903 are disposed around the area 901, to be located on opposite sides of the area 901 respectively. The strip-shaped function multiplexing area 904 is disposed at a periphery of the area 902. The area 905 surrounds the function multiplexing area 904 and a portion of the area 903. The area 906 is disposed on one side of the area 905. The area 908 surrounds an area formed by the areas 901 to 906. The area 909 is disposed on one side of the area 906. The area 910 is disposed on one side of the area 909 opposite to the area 906, and two portions of the area 907 are disposed on other sides of the area 909 respectively.

Although various areas on the display apparatus 800 described above are illustrated in a specific shape and layout in FIG. 9, it will be apparent to those skilled in the art that the embodiments of the present disclosure are not limited thereto, and types, numbers, shapes, structures and arrangements of areas of the display apparatus 800 for arranging various components may be selected as needed.

In the embodiments of the present disclosure, the function multiplexing unit is disposed in the display driving apparatus, and the function multiplexing circuit may be controlled by using a signal to realize a test function and an electrostatic protection function, without designing a separate test circuit and a separate electrostatic protection circuit. The function multiplexing circuit 01 may be disposed in the same area (for example, the area 904) of the display apparatus 800 without providing a separate area for the test circuit and a separate area for the electrostatic protection circuit, which saves a space and reducing difficulty in wiring, thereby solving the problem that it is difficult to arrange both the test circuit and the electrostatic protection circuit on the display apparatus having a limited space.

Figure 10:
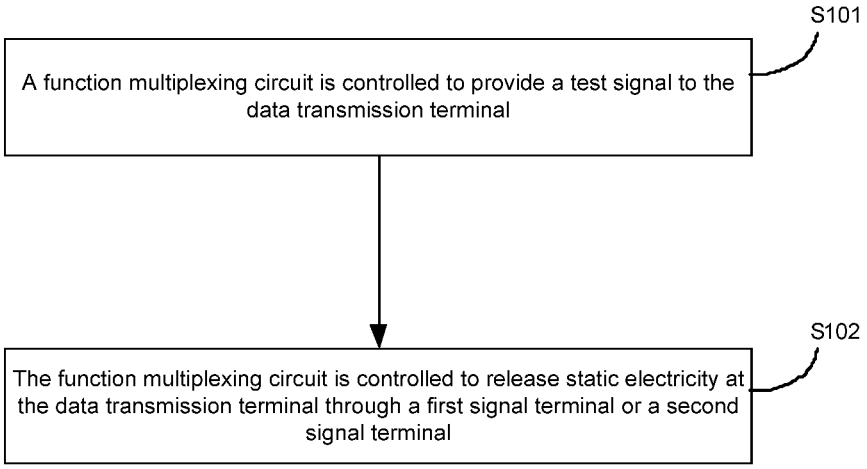
FIG. 10 illustrates a flowchart of a method for controlling a display driving circuit according to an embodiment of the present disclosure.

The embodiments of the present disclosure provide a method for driving the display driving circuit according to the embodiment of the present disclosure. The following description is made by taking transistors being all N-type transistors, a high level being +5V and a low level being −5V as an example. As shown in FIG. 10, the method may comprise the following steps.

In step S101, the function multiplexing circuit 10 is controlled by using signals at the enabling signal terminal SW, the first signal terminal 102, and the second signal terminal 103 to provide a test signal to the data transmission terminal 101, which may be referred to as a "test phase." For example, the first multiplexing sub-circuit 11 of the function multiplexing circuit 10 inputs the signal at the first signal terminal 102 to the data transmission terminal 101 to provide a test signal to the data line connected to the data transmission terminal 101. Further, the second multiplexing sub-circuit 12 of the function multiplexing circuit 10 stabilizes a voltage at the data transmission terminal 101 under control of the second signal terminal 103 and the data transmission terminal 101.

For example, in the test phase, the enabling signal at the enabling control terminal SW of the function multiplexing circuit 10 is at a high level, the power supply signal VGH at the second signal terminal 103 of the function multiplexing circuit 10 is at a high level, and the test signal is input to the first signal terminal 102. The first transistor T1 is turned on due to the high level at the enabling signal terminal SW, and the test signal at the first signal terminal 102 may be transmitted to the data line DL of the display panel through the data transmission terminal 101.

The high level of the test signal at the first signal terminal 102 is set to be the same as the high level of the power supply signal VGH at the second signal terminal 103, so that when the test signal at the first signal terminal 102 is at a high level, the data transmission terminal 101 is at a high level, and the second transistor T2 has a gate-source voltage Vgs=0 because the gate of the second transistor T2 is at the same potential as that of the second electrode thereof, thereby the second transistor T2 is turned off. In this case, if there is high static electricity in the signal input at the first signal terminal 102, there is also high static electricity in the signal output through the data transmission terminal 101, the gate of the second transistor T2 is at an increased potential. When the gate-source voltage Vgs of the second transistor T2 is greater than a threshold voltage Vth thereof, the second transistor T2 is turned on. At this time, the static electricity described above is conducted to the second signal terminal 103 through the second transistor T2, thereby maintaining the data transmission terminal 101 at the high level described above. Therefore, the second transistor T2 may stabilize the voltage at the data transmission terminal 101.

When the first signal terminal 102 is at a low level, the data transmission terminal 101 is at a low level, and at this time, the second transistor T2 is turned off.

In step S102, the function multiplexing circuit 10 is controlled by using signals at the enabling signal terminal SW, the first signal terminal 101 and the second signal terminal 102 to release static electricity at the data transmission terminal 101 through the first signal terminal 102 or the second signal terminal 103. This phase may be referred to as an "electrostatic protection phase." For example, the first multiplexing sub-circuit 11 of the function multiplexing circuit 10 releases the static electricity at the data transmission terminal 101 through the first signal terminal 102 under control of the enabling signal terminal SW and the first signal terminal 102; and the second multiplexing sub-circuit 12 releases the static electricity at the data transmission terminal 101 through the second signal terminal 103 under control of the second signal terminal 103 and the data transmission terminal 101.

For example, in the electrostatic protection phase, the data signal provided by the source driver is transmitted to the data line DL of the display panel through the data transmission terminal 101, the enabling control terminal SW and the first signal terminal 102 are at a low level, and the third signal terminal 103 is at a high level. At this time, the equivalent circuit diagram of FIG. 3 is as shown in FIGS. 4*a* and 4*b*, in which the first transistor T1 and the second transistor T2 operate as a diode D1 and a diode D2, respectively. A positive electrode of the diode D1 is connected to a low level, and a negative electrode of the diode D2 is connected to a high level.

When there is large positive static electricity (at for example, +30V) in the data signal which is provided by the source driver to the data line DL, the static electricity flows to the diode D2 in a direction indicated by solid arrows in FIG. 4*a*. Here, a positive electrode of the diode D2 is connected to +30V, and the negative electrode of the diode D2 is connected to +5V. Therefore, the diode D2 is in a turn-on state. At this time, the large positive static electricity is conducted to the diode D2 and is released through the second signal terminal 103.

When there is large negative static electricity (at for example, −30V) in the data signal which is provided by the source driver to the data line DL, the static electricity flows to the diode D1 in a direction indicated by solid arrows in FIG. 4*b*. Here, the positive electrode of the diode D1 is connected to −5V, and a negative electrode of the diode D1 is connected to −30V. Therefore, the diode D1 is in a reverse breakdown state. At this time, the static electricity is conducted to the diode D1, and is released through the first signal terminal 102.

Based thereon, the display driving circuit is driven in a time-division manner, so that in a test phase, a signal at the first signal terminal 102 is input to the data transmission terminal 101 under control of the enabling signal terminal SW, the first signal terminal 102 and the second signal terminal 103, to provide a test signal to the data line connected to the data transmission terminal 101, thereby achieving test of the display performance of the pixels in the display panel; and in an electrostatic protection phase, static electricity at the data transmission terminal 101 is released through the first signal terminal 102 or the second signal terminal 103 under control of the enabling signal terminal SW, the first signal terminal 102 or the second signal terminal 103. Thereby, after the design of the display driving circuit 01 is completed, wirings and a layout related to a static electricity elimination unit and a display performance test unit may be completed at the same time, thereby effectively solving the problem that a static electricity elimination circuit cannot be designed because of a small space of a small-sized display panel which results in difficulty in the layout and the wirings.

In addition, in the above step S102, the first multiplexing sub-circuit 11 comprises a first transistor T1, and releasing by, the first multiplexing sub-circuit 11, the static electricity at the data transmission terminal 101 through the first signal terminal 102 may comprise:

inputting the same voltage signal to the enabling signal terminal SW and the first signal terminal 102, so that the first transistor T1 is in a diode turned-off state.

When the first transistor T1 is an N-type transistor, a low level is input to the enabling signal terminal SW and the first signal terminal 102, so that the first transistor T1 is in a diode turned-off state. When there is large negative static electricity in the signal at the data transmission terminal 101, the first transistor T1 may be reversely broken down, and thereby the large negative static electricity is released through the first signal terminal 102.

In order to avoid the problem that the liquid crystal in the display panel ages due to an unchanged rotation angle of the liquid crystal for a long time or a small rotation angle of the liquid crystal, a column inversion driving method is usually used in the display driving circuit. For example, in the above step S101, providing, by the first multiplexing sub-circuit 11, a test signal to the data line connected to the data transmission terminal 101 may comprise:

for a first image frame, inputting a high level to the first signal terminal 102 of the function multiplexing circuit 10*a*; and inputting a low level to the first signal terminal 102 of the function multiplexing circuit 10*b*; and for a second image frame, inputting a low level to the first signal terminal 102 of the function multiplexing circuit 10*a*; and inputting a high level to the first signal terminal 102 of the function multiplexing circuit 10*b*. In some embodiments, the first image frame and the second image frame may be two adjacent image frames. Of course, the embodiments of the present disclosure are not limited thereto, and the first image frame and the second image frame may each comprise one or more image frames.

Since data signals of two adjacent data lines are at opposite levels, when a screen of two adjacent image frames is displayed, a data signal is continuously inverted between a high level and a low level, and even if the screen has a small change in grayscale, the rotation angle of the liquid crystal may continuously change, so that the phenomenon that the liquid crystal ages due to an unchanged rotation angle of the liquid crystal for a long time is alleviated.

The above description is only specific embodiments of the present disclosure, and the protection scope of the present disclosure is not limited thereto. Changes or substitutions which may be easily reached by those skilled in the art within the technical scope of the present disclosure should be covered within the protection scope of the present disclosure. Therefore, the protection scope of the present disclosure should be determined by the protection scope of the claims.

We claim:

1. A display driving circuit, comprising a plurality of function multiplexing circuits, wherein each of the plurality of function multiplexing circuits comprises-a data transmission terminal, an enabling signal terminal, a first signal terminal and a second signal terminal, and is configured to provide a test signal to the data transmission terminal and release static electricity at the data transmission terminal through the first signal terminal or the second signal terminal under control of signals at the enabling signal terminal, the first signal terminal, and the second signal terminal, wherein the data transmission terminal is configured to be connected to at least one data line in a display panel, and wherein each function multiplexing circuit comprises a first multiplexing sub-circuit and a second multiplexing sub-circuit, wherein:

the first multiplexing sub-circuit is connected to the enabling signal terminal, the first signal terminal, and the data transmission terminal, and is configured to input the signal at the first signal terminal to the data transmission terminal and release the static electricity at the data transmission terminal through the first signal terminal under control of the signals at the enabling signal terminal and the first signal terminal; and the second multiplexing sub-circuit is connected to the second signal terminal and the data transmission terminal, and is configured to stabilize a voltage at the data transmission terminal and release the static electricity at the data transmission terminal through the second signal terminal under control of the second signal terminal and the data transmission terminal.

2. The display driving circuit according to claim 1, wherein the first multiplexing sub-circuit comprises a first transistor, wherein the first transistor has a gate connected to the enabling signal terminal, a first electrode connected to the data transmission terminal, and a second electrode connected to the first signal terminal.

3. The display driving circuit according to claim 1, wherein the second multiplexing sub-circuit comprises a second transistor, wherein the second transistor has a gate and a first electrode connected to the data transmission terminal, and a second electrode connected to the second signal terminal.

4. The display driving circuit according to claim 1, further comprising a multiplexer, wherein the multiplexer is connected to gating control terminals, the at least one data line, and the data transmission terminals of the plurality of function multiplexing circuits, and is configured to output a signal at each of the data transmission terminals to a respective one of the at least one data line under control of gating signals at the gating control terminals.

5. The display driving circuit according to claim 1, further comprising: a source driver connected to the data transmission terminals of the plurality of function multiplexing circuits, and configured to provide a data signal to the data transmission terminals.

6. A display apparatus, comprising the display driving circuit according to claim 1.

7. A method for controlling the display driving circuit according to claim 1, the method comprising: for each of the plurality of function multiplexing circuits, in a test phase, controlling, by using signals at the enabling signal terminal, the first signal terminal, and the second signal terminal, the function multiplexing circuit to provide a test signal to the data transmission terminal; and in an electrostatic protection phase, controlling, by using signals at the enabling signal terminal, the first signal terminal, and the second signal terminal, the function multiplexing circuit to release static electricity at the data transmission terminal through the first signal terminal or the second signal terminal.

8. The method according to claim 7, wherein:

each function multiplexing circuit comprises a first multiplexing sub-circuit and a second multiplexing sub-circuit;

controlling the function multiplexing circuit to provide a test signal to the data transmission terminal comprises: controlling, by using the signals at the enabling signal terminal and the first signal terminal, the first multiplexing sub-circuit to input a signal at the first signal terminal to the data transmission terminal as a test signal, and controlling, by using the signals at the second signal terminal and the data transmission terminal, the second multiplexing sub-circuit to stabilize a voltage at the data transmission terminal; and controlling the function multiplexing circuit to release static electricity at the data transmission terminal through the first signal terminal or the second signal terminal comprises: controlling, by using the signal at the enabling signal terminal and the first signal terminal, the first multiplexing sub-circuit to release static electricity at the data transmission terminal through the first signal terminal, and controlling, by using the signals at the second signal terminal and the data transmission terminal, the second multiplexing sub-circuit to release the static electricity at the data transmission terminal through the second signal terminal.

9. The method according to claim 7, wherein the plurality of function multiplexing circuits comprise at least one group of two function multiplexing circuits, one of which is a first function multiplexing circuit and the other of which is a second function multiplexing circuit, and wherein controlling each function multiplexing circuit to provide a test signal to the data transmission terminal comprises:

for a first image frame, applying a first level to the first signal terminal, and applying a second level to the first signal terminal of the second function multiplexing circuit; and for a second image frame, applying a second level to the first signal terminal of the first function multiplexing circuit, and applying a first level to the first signal terminal of the second function multiplexing circuit.

10. The display driving circuit according to claim 2, wherein the second multiplexing sub-circuit comprises a second transistor, wherein the second transistor has a gate and a first electrode connected to the data transmission terminal, and a second electrode connected to the second signal terminal.

11. The display driving circuit according to claim 4, wherein the plurality of function multiplexing circuits comprise at least one group of two function multiplexing circuits, one of which is a first function multiplexing circuit and the other of which is a second function multiplexing circuit; and the multiplexer comprises a plurality of gating sub-circuits, each connected to a respective one of the at least one group and respective L data line(s) of the at least one data line, wherein each of the gating sub-circuits comprises L gating device(s), wherein odd-numbered one(s) of the L gating device(s) is(are) connected to the first function multiplexing circuits and odd-numbered one(s) of the L data line(s), and even-numbered one(s) of the L gating devices is(are) connected to the second function multiplexing circuits and even-numbered one(s) of the L data line(s), where L is a positive integer.

12. The display apparatus according to claim 11, wherein the display apparatus has a plurality of layout areas, and the plurality of function multiplexing circuits are located in one of the plurality of layout areas.

13. The method according to claim 8, wherein the first multiplexing sub-circuit comprises a first transistor, and controlling the first multiplexing sub-circuit to release static electricity at the data transmission terminal through the first signal terminal comprises:

applying the same level to the enabling signal terminal and the first signal terminal.

* * * * *